United States Patent [19]

Hahn

[11] Patent Number: 4,540,931

[45] Date of Patent: Sep. 10, 1985

[54] VARIABLE TRANSFORMER AND VOLTAGE CONTROL SYSTEM

[75] Inventor: Steven Hahn, East Hampton, N.Y.

[73] Assignee: Regulation Technology, Inc., New York, N.Y.

[21] Appl. No.: 508,059

[22] Filed: Jun. 24, 1983

[51] Int. Cl.[3] ..... G05F 1/14

[52] U.S. Cl. ..... 323/264; 323/256

[58] Field of Search ..... 323/250, 255, 256, 257, 323/259, 260, 264, 331, 344, 347, 348; 336/117, 118, 119, 130, 135

[56] References Cited

U.S. PATENT DOCUMENTS

| | | | |
|---|---|---|---|
| 1,756,875 | 4/1930 | Montsinger | 323/301 |
| 1,919,960 | 7/1933 | Miyamoto | 323/263 |
| 2,046,496 | 7/1936 | Wiskott et al. | 336/130 |
| 2,134,517 | 10/1938 | Jones . | |
| 2,202,024 | 3/1940 | Ratkovszky | 323/259 |
| 2,254,918 | 9/1941 | Schwaiger | 323/260 |
| 2,306,000 | 12/1942 | Stilphen | 323/260 |
| 2,514,908 | 7/1950 | Stilphen | 323/347 |
| 2,830,255 | 4/1958 | Blasio | 323/301 |
| 2,957,149 | 10/1960 | Dittrich et al. | 336/135 |
| 3,042,851 | 7/1962 | Little | 323/260 |
| 3,074,036 | 1/1963 | Utter | 336/135 |
| 3,152,311 | 10/1964 | Bojarski | 336/135 |
| 3,235,824 | 2/1966 | Kober | 336/135 |
| 3,373,345 | 3/1968 | Hung | 323/260 |
| 3,477,027 | 11/1969 | Jablonski | 323/347 |
| 3,551,866 | 12/1970 | Chass | 336/132 |
| 4,112,404 | 9/1978 | Boushey | 336/135 |
| 4,125,782 | 11/1978 | Pollnow, Jr. | 327/38 |
| 4,245,319 | 1/1981 | Hedges | 307/38 |

FOREIGN PATENT DOCUMENTS

| | | |
|---|---|---|
| 879408 | 6/1953 | Fed. Rep. of Germany . |
| 210227 | 2/1924 | United Kingdom . |

OTHER PUBLICATIONS

Norris, E. T., "Moving Coil Voltage-Regulator Family", pp. 674–676, Electronics and Power, Jun. 12, 1975.

*Primary Examiner*—Peter S. Wong
*Assistant Examiner*—Judson H. Jones
*Attorney, Agent, or Firm*—Robert Scobey

[57] ABSTRACT

A system for automatically controlling output voltage to correct for varying input voltage utilizes a transformer having a movable core structure. The output voltage from the transformer is sensed and made to conform to a predetermined standard by moving the movable core structure, which is then locked in position after its adjustment. Voltage changes are step-free, and linear voltage control with respect to time is achieved through non-linear movement of the core structure over a range of variation of the output voltage.

30 Claims, 5 Drawing Figures

VARIABLE TRANSFORMER AND VOLTAGE CONTROL SYSTEM

BACKGROUND AND BRIEF DESCRIPTION OF THE INVENTION

This invention relates to voltage control systems. It has particular application to the control of voltage by a consumer supplied with power from a utility system. The invention is also directed to providing a variable transformer in which a moving core structure is used to achieve step-free voltage control in response to changing input voltages, and in which output voltage is made to change linearly with respect to time.

Power control systems are known. Many involve some form of load shedding, which is undesirable, since it requires removal of one or more devices from use. The present invention is directed to a power control system using voltage control as a principal factor, but also utilizes load shedding or load reduction as desired.

In the past, much publicity has been given to the "brown-out" condition, in which the voltage supplied by a utility to a consumer falls below a desired level. Little attention has been given to the supplying of excessive voltage by a utility. Since a consumer pays for electricity upon the basis of power consumed, i.e., the product of voltage and current and phase angle and since current and power usually increase when voltage increases, excessive power is consumed and paid for by a consumer when voltage increases beyond a desired level. The present invention is directed toward a system for handling conditions of excessive voltage, as well as insufficient voltage, i.e., to supply correct voltage in response to varying input voltage conditions.

The present invention utilizes a variable transformer as a control device. In the past, variable transformers for voltage control purposes have generally involved moving coils or changing/sliding electrical contacts. Both arrangements are undesirable, since electrical conductors are being moved or switched in and out of a circuit, accompanied by arcing, noise, losses, wear, and other problems. The present invention utilizes a transformer structure involving fixed coils, and no moving contacts. Instead, a part of the magnetic core structure is movable, to change the magnetic flux in the transformer that links the windings in the transformer, so as to achieve voltage control. Although movable transformer core structures have been utilized in the past, most have been for manual operation and not for automatic control as in the present invention. Although it has been proposed before to sense voltage and to control the position of a movable core structure in response thereto, the control mechanism has been spring biased or otherwise relatively freely movable, rendering it unsuitable for use in systems involving large currents, in which the magnetic forces generated are such as to cause movement of the movable core structure to a rest position. In the present invention, a movable core structure is locked in position following any adjustment.

Additionally, the present invention utilizes a non-linear movement of the movable core structure, so as to achieve linear changes in voltage over time. In particular, as the movable core structure moves away from a position adjacent to a pole piece, increasing an air gap, the magnetic flux linking these two members would normally sharply decrease, causing an abrupt and sharp voltage change. In the present invention, the movable core structure is made to move relatively slowly when the increasing air gap is encountered, thereby to eliminate this undesirable effect.

The invention will be more completely understood by reference to the following detailed description of presently preferred embodiments thereof.

DETAILED DESCRIPTION

Figure 1:
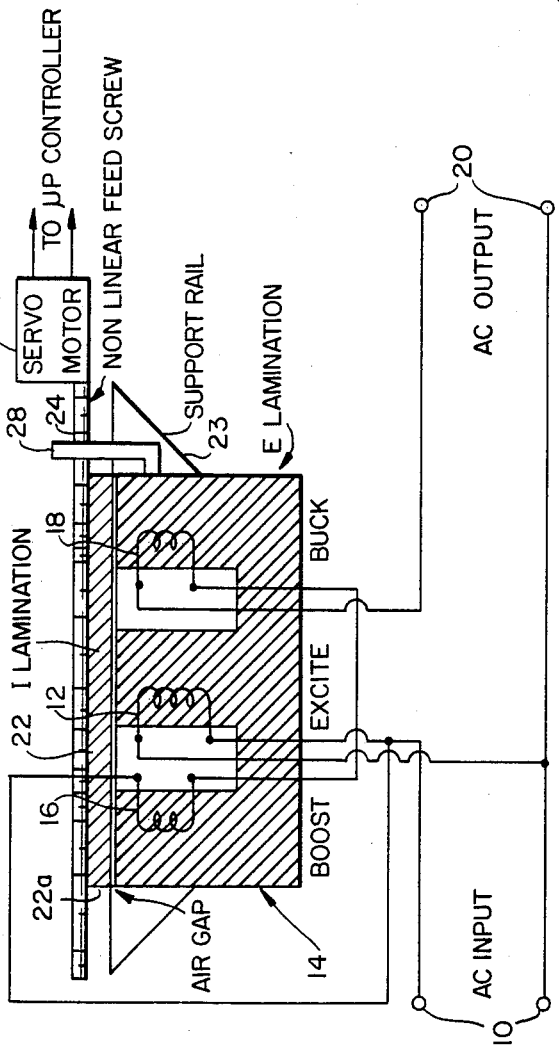
FIG. 1 is a diagrammatic representation of a transformer structure embodying the invention.

Referring to FIG. 1, a pair of input terminals 10 receive an AC input from a utility. As an example, this is the AC input to a home, and represents the power supplied by the utility on the home or use side of the meter (not shown) that monitors power delivered to the user. The AC input is applied to a fixed excitation winding 12 that forms part of a transformer 14. The excitation winding 12 is always energized by the input voltage appearing at the terminals 10. One of those terminals (the uppermost one in FIG. 1) is also connected in series with two series-connected transformer secondary windings 16 and 18. The winding 16 is designated a "boost" winding, while the winding 18 is designated a "buck" winding. The two windings generate potentials which oppose each other, and are thus inserted in series in the "hot" leg of the line. The neutral line in the system is the lowermost electrical conductor in FIG. 1. Thus the AC output appears across terminals 20.

Figure 6:
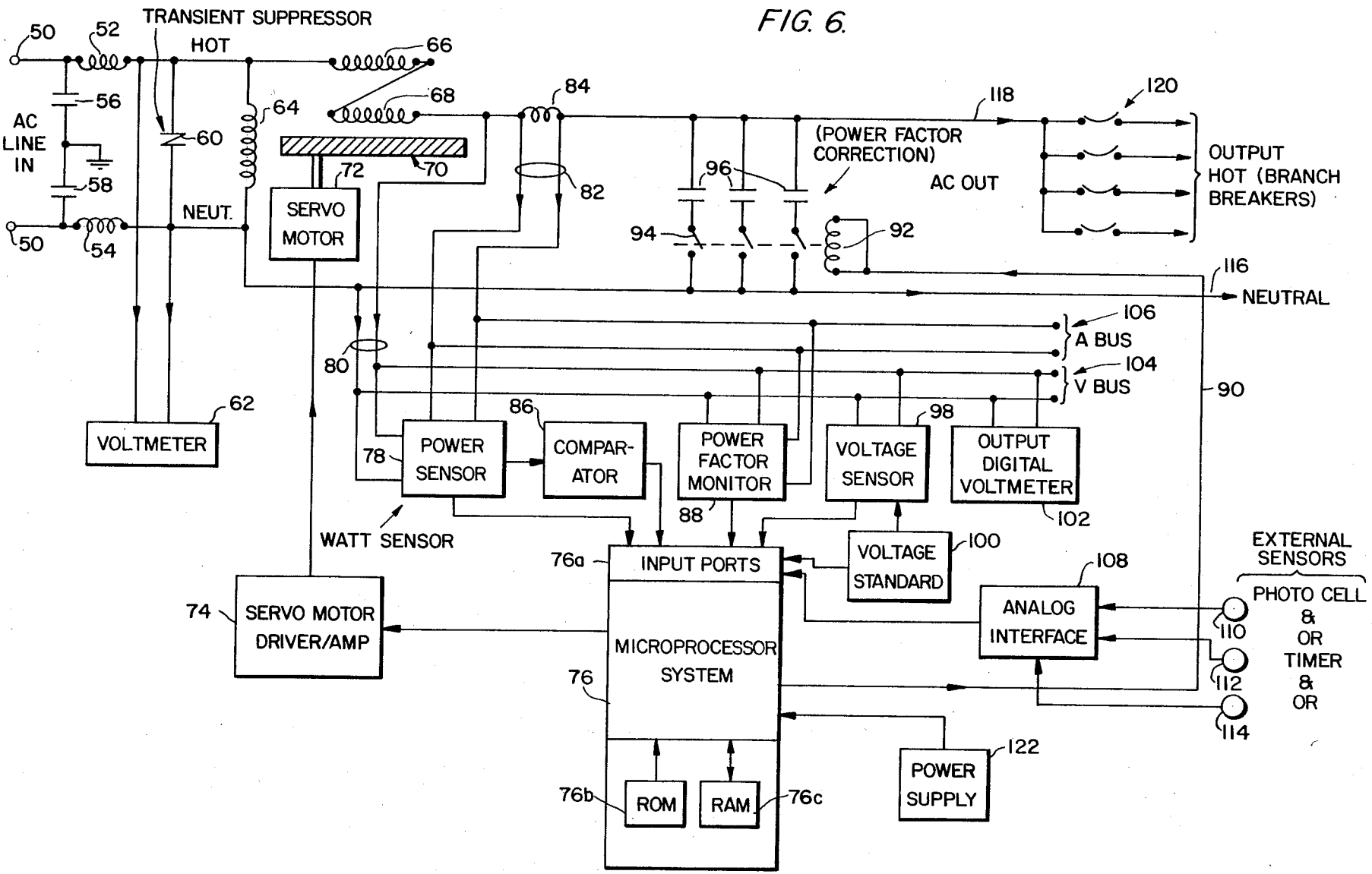
FIG. 6 is a block diagram of an overall system for voltage control embodying the invention.

The transformer in FIG. 1, which is a presently preferred embodiment, is a conventional, E-type transformer structure. The conventional fixed I lamination is not included within the E lamination stack. Instead, the I lamination in FIG. 1, designated 22, bridges the entire E lamination structure and is movable. In particular, it is carried by a support rail system 23, riding immediately above the E laminations. The spacing between the I and E laminations is normally in the order of a few thousandths of an inch. The position of the movable core structure 22 is controlled by a feed screw 24. Preferably, the feed screw is non-linear, e.g., by having a varying thread pitch. This non-linearity is the reason for a linear voltage control, as will be explained in more detail below. The feed screw 24 is under the control of a servo motor 26 which is in turn controlled by a microprocessor system, such as is shown in FIG. 6 to be explained in detail below.

Figure 2:
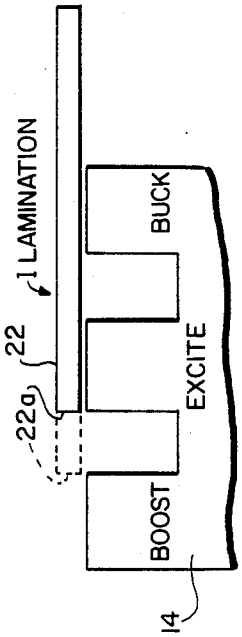
FIG. 2 is a simplified view of the structure of FIG. 1, showing the movable core structure in a position to lower the input voltage by a maximum amount.

In the relative positions of the movable core structure 22 and the fixed E core structure in FIG. 1, both the boost winding 16 and the buck winding 18 develop the same potentials, which cancel each other, and hence the AC input voltage at the terminals 10 appears as the AC output voltage at the terminals 20 (except for very small losses within the transformer system itself). Assume that the servo motor 26 moves the movable core structure 22 to the position shown in FIG. 2. In this position the boost winding 16 of FIG. 1 is essentially ineffective, since the movable core structure 22 does not provide a completed flux path for that winding. The flux path for the buck winding 18, on the other hand, is totally completed, and hence the buck winding develops its maximum potential which is subtracted from the input potential appearing at the input terminals 10. The AC output potential appearing across the terminals 20 is thus reduced by the maximum amount.

Conversely, if the movable core structure 22 is moved by the servo motor 26 of FIG. 1 to its other extreme position, in which the buck winding 18 is essentially isolated, the maximum addition in input voltage is provided by the boost coil 16, resulting in a maximum raising of the AC output potential in the terminals 20 over the input potential at the terminals 10.

Variable voltage control at the AC output terminals 20 may be achieved by suitable energization of the servo motor 26 and movement of the movable core structure 22. At any time that the servo motor 26 is not operating, and the core structure 22 is not moving, that core structure is effectively locked in position and cannot be moved. Thus even if forces are developed within the transformer core structures tending to move the movable core piece 22 to a position which maximizes flux linkage between the core pieces, no movement of the core structure 22 can result except as occasioned by the servo motor 26.

Because of the feed screw 24, movement of the core piece 22 is continuous, and there need be no abrupt step-like changes in output voltage at the terminals 20. Smooth variation of output potential is also achieved by utilizing a non-linear feed screw. As indicated above, the pitch of the feed screw is made to vary. In particular, the pitch is the greatest (the threads are most widely spaced apart) in that portion of the feed screw 24 that engages threaded support 28 when the moving core piece 22 is in the position such as shown in FIG. 1. However, assume a condition in which forward end 22*a* of the movable core structure 22 is moving from adjacent the fixed pole piece that carries the boost winding 16 (as shown in dashed line in FIG. 2). During this time when the movable core piece is virtually leaving the pole piece, the flux linking the pole pieces is undergoing a rapid change, and at this time the threads of the feed screw 24 pull the movable pole piece 22 very slowly (the threads are most closely spaced). In this fashion, a feed screw of non-linear pitch produces a linear voltage change with respect to time.

In other words, the movable core structure 22 is moved at a rate which decreases as the gap between that core element and one of the boost and buck coils increases. The thread pitch varies so that it is greater when end 22*a*, for example, of the movable core piece 22 is positioned between adjacent ones of the fixed E pole pieces than when the end 22*a* is positioned over one of those pole pieces.

Figure 3:
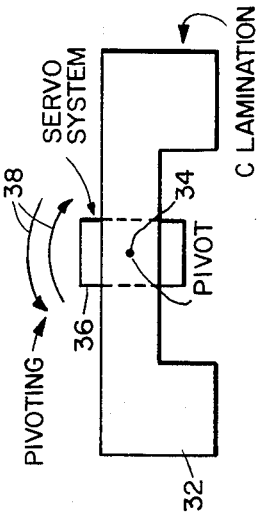
FIG. 3 is a simplified top view of another transformer structure embodying the invention.
Figure 4:
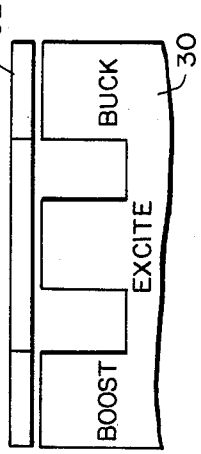
FIG. 4 is a side view of the transformer structure of FIG. 3.

An alternative transformer structure is shown in FIGS. 3 and 4. A fixed core structure 30 of E type as in FIG. 1 may be employed, together with a C-type lamination or movable core piece 32. The movable core piece 32 is pivoted about a pivot axis 34 by any suitable servo motor 36. Pivoting is as shown by arrows 38 in FIG. 3. A non-linear feed screw such as the feed screw 24 may be employed in the system of FIG. 3 to achieve the smooth voltage control as in the system of FIG. 1.

In both systems of FIGS. 1 and 3 and 4, linear mechanical drive mechanisms may be employed, if desired, in conjunction with a variable speed servo motor or non-linear movement under the control of a microprocessor, as in the system of FIG. 6 to be described below.

Figure 5:
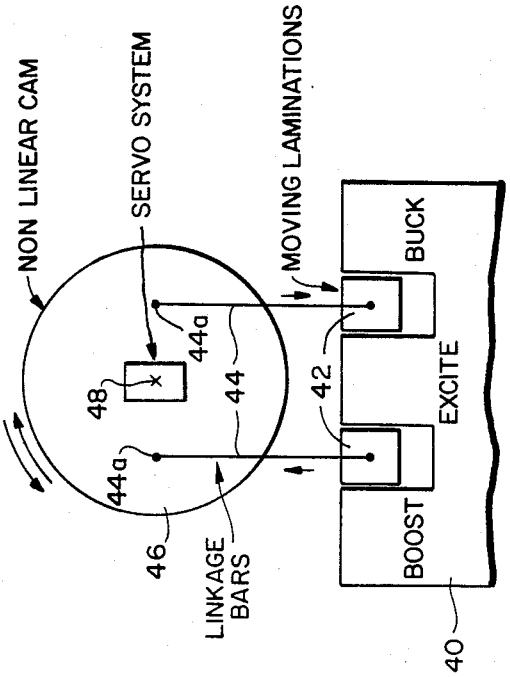
FIG. 5 is a simplified view of another transformer structure embodying the invention.

FIG. 5 illustrates another transformer system involving an E-type fixed core structure 40. In this case, movable core pieces 42 are employed that move in the gaps between the fixed pole pieces, each moving along a line of movement. The movable pole pieces 42 are driven by linkage bars 44 which are pivotally coupled each at one end thereof (as at 44*a*) to a drive member 46 that is pivotable about a pivot axis 48. The other ends of the linkage bars 44 are pivotally coupled to the movable core pieces 42. Arcuate movement of the end of the linkage bar 44 coupled to the drive member 46 (about the pivot axis 48) causes movement of the movable core piece. That movement is greatest in the position of the drive member 46 shown in FIG. 5. When the drive member 46 is pivoted to a position in which one of the movable core pieces 42 is leaving the region between the fixed core pieces (i.e., the air gap is increasing), the movement of that core piece is slowed, thereby causing a linear voltage change to take place over time rather than non-linear.

FIG. 6 shows an overall system incorporating one of the transformer mechanisms described above, and also utilizing microprocessor control. The AC line input appears at terminals 50. A noise suppression filter formed from coils 52 and 54 and capacitors 56 and 58 is included. A transient suppressor 60 between the lines may also be utilized, e.g., a V Mos type device. Input voltage is monitored by the volt meter 62.

A variable transformer, of the type described above, is utilized involving excitation winding 64 and boost winding 66, and buck winding 68, in conjunction with movable core structure 70, all under the control of a servo motor 72. That servo motor is under the control of a driver/amplifier unit 74 which, in turn, is controlled by a microprocessor system 76.

A power or watt sensor 78 is utilized, receiving voltage input signals from the transformer output via conductors 80 and a signal on conductors 82 representing current flow in the system. The conductors 82 are connected to a current transformer 84. The power sensor 78 develops an output signal which is applied to the microprocessor system 76 via input ports 76*a* of that system. A comparator 86 may be included, as desired, settable by the user to a peak demand setting (in watts) desired by the user. This comparator is thus applied by a signal from the power sensor 78. If the peak demand is sensed by the comparator 86, a suitable output signal is developed, applied to the microprocessor system, causing that system to control the servo motor driver/amplifier 74 to reduce the output voltage, and causing a concomitant reduction in consumed power.

A power factor monitor 88 may be employed, as desired, receiving input signals from the current transformer 84 representing current flowing in the system, as well as voltage signals from the conductors 80 representing voltage in the system. The power factor monitor 88 thus develops a signal applied to the microprocessor system 76 which may be used for the correction of power factor, as desired. In particular, the microprocessor system 76 may develop a signal upon conductor 90 (a bus conductor) which energizes relay 92 to cause switches 94 to be closed, thereby switching across the AC output lines of the system power factor correction capacitors 96. It should be noted that inductive loading is the most commonly encountered cause of power factor deterioration. Thus, capacitive correction has been shown as a feature in the system of FIG. 6. Obviously, inductive correction could be employed in a system involving heavy capacitive loading.

In the system of FIG. 6, the AC output potential of the transformer system, as monitored via the conductors 80, is used for voltage sensing by a voltage sensor 98. That sensed voltage is supplied to the microprocessor system 76. A voltage standard may be set by the user in unit 100, so that the microprocessor system 76 may compare the actual voltage as sensed by the sensor 98 with that desired (as indicated by the standard 100). Suitable control signals are thus developed by the microprocessor system, controlling the servo motor driver/amplifier 74 to change in turn the output voltage of the system through the variable transformer described above.

An output indicator 102 may be employed to provide a visual indication of the voltage output in the system, e.g., an output digital volt meter. In this regard, it should be noted that a voltage output "bus" 104 is provided, as well as a current output indication bus 106 for the purpose of further monitoring of output voltage and amperage, as desired. The bus 104 is taken from the conductors 80, while the bus 106 is taken from the current transformer 84.

An interface 108 may be included to couple various external sensors such as photo cell 110, timer 112, or other external sensing device 114 to the microprocessor system 76. All of these external sensors may be utilized to provide control of the voltage in the system in accordance with various external criteria, such as time of day, ambient light conditions, temperature, to name some examples. For example, if the system of FIG. 6 is used principally with regard to a lighting load, it may be desired to reduce the output voltage and concomitantly the generated light output in the event that ambient light increases over a certain level, or nighttime conditions prevail (when it is desired to achieve a minimal, dim lighting level). Many factors may be monitored and used for voltage control purposes.

To complete the description of the system of FIG. 6, the output voltage from the variable transformer system appears across neutral conductor 116 and "hot" conductor 118. Multiple circuit breakers 120 may be employed to provide branch circuits. For load shedding purposes, any one or more of these circuit breakers may be under the control of the microprocessor system 76, to open the breakers and to shed loads, as desired, in the event that power consumption remains excessive notwithstanding other corrective measures being taken by the system of FIG. 6.

A power supply 122 conventionally supplies the microprocessor system and other of the devices with power, as necessary, for functioning.

The microprocessor system 76 is conventional and may comprise conventional analog-digital convertors and a microprocessor such as a Motorola 6500 series, an Intel 8080 model, and other suitable microprocessor units. The microprocessor system 76 includes read only memory (ROM) **76*b* and random access memory(-RAM) 76*c*. The operating instructions for the system would reside in the ROM 76*b*, while the data representing monitored conditions and desired conditions, as developed by the various monitors and sensors described above, reside in the memory 76*c***.

The invention described above has been explained in terms of presently preferred embodiments thereof. In particular, a single phase system has been shown. Obviously, the invention is applicable to multi phase systems. These and other changes and modifications will be readily apparent to those skilled in the art. Accordingly, the invention should be taken to be defined by the following claims.

What is claimed is:

1. A system for automatically controlling output voltage in a system supplied with a varying input voltage comprising a transformer supplied with said input voltage and producing said output voltage and having coils and a movable core structure, the position of said core structure determining the relation between said input and output voltages, said movable core structure including means for locking the position of said movable core structure in any position within a predetermined range, and control means responsive to variation in said output voltage for varying the position of said movable core structure to maintain said output voltage at a predetermined value, in which said control means moves said movable core structure nonlinearly over a range of variation of said output voltage.

2. A system according to claim 1, in which said transformer includes a boost coil for adding voltage and a buck coil for subtracting voltage, and said movable core structure varies the potential developed by each of said boost and buck coils.

3. A system according to claim 2, in which said movable core structure includes a core element movable in proximity to said boost and buck coils.

4. A system according to claim 3, in which said movable core structure is moved at a rate which decreases as the gap between said core element and one of said boost and buck coils increases.

5. A system according to claim 3, in which said transformer includes a fixed core structure having fixed pole faces in a first plane, and said movable core structure comprises a member having at least one pole face movable in a plane parallel to said first plane.

6. A system according to claim 5, in which said movable pole face moves along a line, said control means comprises a feed screw coupled to said movable pole face to move the latter.

7. A system according to claim 6, in which said feed screw includes a thread pitch that varies.

8. A system according to claim 7, in which said thread pitch varies at a control position so that the pitch is greater when an end of said movable pole face is positioned between adjacent ones of said fixed pole faces than when said end is over one of said fixed pole faces.

9. A system according to claim 5, in which said movable core structure has two pole faces and is pivotable so that one face thereof is adjacent one fixed pole face when the other face thereof is remote from another fixed pole face.

10. A system according to claim 3, in which said core element is movable along a line, and said control means comprises a drive member pivotable about a pivot axis, a linkage bar pivotally coupled at one end thereof to said drive member at a point spaced from said pivot axis and at another end thereof to said core element, so that arcuate movement of said one bar end about said pivot axis causes movement of said core element along said line.

11. A system according to claim 10, in which there are two of such core elements movable along lines parallel to each other, and two of such linkage bars coupled to points on said drive member on opposite sides of said pivot axis.

12. A system according to claim 1, in which said control means includes microprocessor means monitoring said output voltage and generating output control signals, and servo motor means coupled to said movable core structure to control the position of the latter in response to said output control signal.

13. A system according to claim 12, in which said microprocessor means monitors electrical current output from said transformer, and including reactive impedance means under control of said microprocessor means and selectively connectable to the output of said transformer to provide for automatic adjustment of the relation between output voltage and current from said transformer.

14. A system according to claim 12, including means for monitoring one or more external conditions and generating one or more sensing signals representing the same which are applied to said microprocessor means to vary the position of said movable core structure in accordance therewith.

15. A system according to claim 12, in which said microprocessor means controls said servo motor means to move said movable core structure at a rate that varies in accordance with the position of said movable core structure with respect to said coils.

16. A system according to claim 15, in which said microprocessor means causes said core speed to decrease as the magnetic flux linkage between said coils and said movable core structure decreases.

17. In a variable transformer having a movable core piece that moves past a pole face, the improvement comprising a controller for controlling the movement of said core piece so that said core piece moves at varying rates depending upon the position of said core piece with respect to said pole face.

18. A variable transformer according to claim 17, in which said controller controls said core piece to move at a rate which decreases as the magnetic flux linkage between said core piece and pole face decreases.

19. A variable transformer according to claim 17, in which said controller comprises a feed screw coupled to said movable core piece, said feed screw having a thread pitch that varies.

20. A variable transformer according to claim 19, in which said thread pitch varies so that it decreases at a control position as the magnetic flux linkage between said core piece and pole face decreases.

21. A variable transformer according to claim 17, including a generally C-shaped fixed core piece and a generally C-shaped movable core piece superimposed with respect thereto, and said controller comprises a pivotal mounting of said movable core piece with respect to said fixed core piece.

22. A variable transformer according to claim 17, in which said movable core piece is movable along a line, and said controller comprises a drive member pivotable about a pivot axis, a linkage bar pivotally coupled at one end thereof to said drive member at a point spaced from said pivot axis and at another end thereof to said movable core piece, so that arcuate movement of said one bar end about said pivot axis causes movement of said movable core piece along said line.

23. A variable transformer according to claim 17, in which said controller comprises a microprocessor generating a control signal for controlling the movement of said core piece in accordance with a monitored condition.

24. A system for automatically controlling output voltage in a system supplied with a varying input voltage comprising a transformer supplied with said input voltage and producing said output voltage and having coils and a movable core structure, the position of said core structure determining the relation between said input and output voltages, said movable core structure including means for locking the position of said movable core structure in any position within a predetermined range, and control means responsive to variation in said output voltage for varying the position of said movable core structure to maintain said output voltage at a predetermined value, in which said transformer includes a boost coil for adding voltage and a buck coil for subtracting voltage, and said movable core structure varies the potential developed by each of said boost and buck coils, said movable core structure includes a core element movable in proximity to said boost and buck coils, and said movable core structure is moved at a rate which decreases as the gap between said core element and one of said boost and buck coils increases.

25. A system for automatically controlling output voltage in a system supplied with a varying input voltage comprising a transformer supplied with said input voltage and producing said output voltage and having coils and a movable core structure, the position of said core structure determining the relation between said input and output voltages, said movable core structure including means for locking the position of said movable core structure in any position within a predetermined range, and control means responsive to variation in said output voltage for varying the position of said movable core structure to maintain said output voltage at a predetermined value, in which said transformer includes a boost coil for adding voltage and a buck coil for subtracting voltage, and said movable core structure varies the potential developed by each of said boost and buck coils, said movable core structure includes a core element movable in proximity to said boost and buck coils, said transformer includes a fixed core structure having fixed pole faces in a first plane, and said movable core structure comprises a member having at least one pole face movable in a plane parallel to said first plane, said movable pole face moves along a line, said control means comprises a food screw coupled to said movable pole face to move the latter, and said feed screw includes a thread pitch that varies.

26. A system according to claim 25, in which said thread pitch varies at a control position so that the pitch is greater when an end of said movable pole face is positioned between adjacent ones of said fixed pole faces than when said end is over one of said fixed pole faces.

27. A system for automatically controlling output voltage in a system supplied with a varying input voltage comprising a transformer supplied with said input voltage and producing said output voltage and having coils and a movable core structure, the position of said core structure determining the relation between said input and output voltages, said movable core structure including means for locking the position of said movable core structure in any position within a predetermined range, and control means responsive to variation in said output voltage for varying the position of said movable core structure to maintain said output voltage at a predetermined value, in which said control means includes microprocessor means monitoring said output voltage and generating output control signals, and servo motor means coupled to said movable core structure to control the position of the latter in response to said output control signal, and said microprocessor means controls said servo motor means to move said movable core structure at a rate that varies in accordance with the position of said movable core structure with respect to said coils.

28. A system according to claim 27, in which said microprocessor means causes said core speed to decrease as the magnetic flux linkage between said coils and said movable core structure decreases.

29. A system for automatically controlling output voltage in a system supplied with a varying input voltage comprising a transformer supplied with said input voltage and producing said output voltage and having coils and a movable core structure, the position of said core structure determining the relation between said input and output voltages, said movable core structure including means for locking the position of said movable core structure in any position within a predetermined range, and control means responsive to variation in said output voltage for varying the position of said movable core structure to maintain said output voltage at a predetermined value, in which said transformer includes a boost coil for adding voltage and a buck coil for subtracting voltage, and said movable core structure varies the potential developed by each of said boost and buck coils, said movable core structure includes a core element movable in proximity to said boost and buck coils, and said core element is movable along a line, and said control means comprises a drive member pivotable about a pivot axis, a linkage bar pivotally coupled at one end thereof to said drive member at a point spaced from said pivot axis and at another end thereof to said core element, so that arcuate movement of said one bar end about said pivot axis causes movement of said core element along said line.

30. A system according to claim 29, in which there are two of such core elements movable along lines parallel to each other, and two of such linkage bars coupled to points on said drive member on opposite sides of said pivot axis.

* * * * *